US008157012B2

(12) United States Patent
Frazier

(10) Patent No.: US 8,157,012 B2
(45) Date of Patent: Apr. 17, 2012

(54) DOWNHOLE SLIDING SLEEVE COMBINATION TOOL

(76) Inventor: W. Lynn Frazier, Corpus Christi, TX (US)

( * ) Notice: Subject to any disclaimer, the term of this patent is extended or adjusted under 35 U.S.C. 154(b) by 555 days.

(21) Appl. No.: 12/204,938

(22) Filed: Sep. 5, 2008

(65) Prior Publication Data

US 2009/0065194 A1 Mar. 12, 2009

Related U.S. Application Data

(60) Provisional application No. 60/970,817, filed on Sep. 7, 2007.

(51) Int. Cl.
*F21B 43/00* (2006.01)

(52) U.S. Cl. ..... 166/332.8; 166/373; 166/319

(58) Field of Classification Search ..... 166/316, 166/285, 308.1
See application file for complete search history.

(56) References Cited

U.S. PATENT DOCUMENTS

| | | | |
|---|---|---|---|
| 0,244,042 | A | 7/1881 | Farrar |
| 2,368,428 | A | 1/1945 | Saurenman |
| 2,565,731 | A | 8/1951 | Johnston |
| 2,756,828 | A | 7/1956 | Deily |
| 2,853,265 | A | 9/1958 | Clark, Jr. |
| 2,874,927 | A | 2/1959 | Conrad |
| 3,015,469 | A | 1/1962 | Falk |
| 3,159,217 | A | 12/1964 | Hanson |
| 3,275,080 | A | 9/1966 | Nelson et al. |
| 3,289,762 | A | 12/1966 | Schell et al. |
| 3,289,769 | A | 12/1966 | Nelson et al. |
| 3,292,707 | A | 12/1966 | Nelson et at |
| 3,526,278 | A | 9/1970 | Scott |
| 3,606,923 | A | 9/1971 | Berryman |
| 3,980,134 | A | 9/1976 | Amancharla |
| 3,995,692 | A | 12/1976 | Seitz |
| 4,122,898 | A | 10/1978 | Nelson |
| 4,134,455 | A | 1/1979 | Read |

(Continued)

FOREIGN PATENT DOCUMENTS

| | | |
|---|---|---|
| GB | 1423293 | 2/1976 |

OTHER PUBLICATIONS http://www.glossary.oilfield.slb.com/DisplayImage.cfm?ID=636, Schlumberger, Mar. 2006.

*Primary Examiner* — William P Neuder
*Assistant Examiner* — Yong-Suk Ro
(74) *Attorney, Agent, or Firm* — Edmonds & Nolte, PC

(57) ABSTRACT

Systems and methods for the production of hydrocarbons from a wellbore. One or more combination tools can be disposed along a casing string inserted into a wellbore. Each combination tool can contain a body having a bore formed therethrough; a sliding sleeve at least partially disposed in the body; one or more openings disposed about the body at a first end thereof; and a valve assembly and a valve seat assembly at least partially disposed within the bore at a second end thereof. While initially permitting free bi-directional flow of fluids within the casing string, the sliding sleeve within each combination tool can be manipulated to close the valve within the tool, thus permitting pressure testing of the casing string. The sliding sleeve can be further manipulated to open the one or more openings thereby permitting hydraulic fracturing and production of a hydrocarbon zone surrounding the combination tool.

15 Claims, 4 Drawing Sheets

U.S. PATENT DOCUMENTS 4,218,299 A 8/1980 Lindell et al.
4,349,071 A 9/1982 Fish
4,391,337 A 7/1983 Ford et al.
4,427,071 A 1/1984 Carmody
4,433,702 A 2/1984 Baker
4,444,266 A 4/1984 Pringle
4,457,376 A 7/1984 Carmody et al.
4,478,286 A 10/1984 Fineberg
4,510,994 A 4/1985 Pringle
4,531,587 A 7/1985 Fineburg
4,541,484 A 9/1985 Salerni et al.
4,553,559 A 11/1985 Short, III
4,583,596 A 4/1986 Davis
4,605,074 A 8/1986 Barfield
4,637,468 A 1/1987 Derrick
4,687,063 A 8/1987 Gilbert
4,691,775 A 9/1987 Lustig et al.
4,694,903 A 9/1987 Ringgenberg
4,739,799 A 4/1988 Carney et al.
4,813,481 A 3/1989 Sproul et al.
4,969,524 A 11/1990 Whiteley
5,012,867 A 5/1991 Kilgore
5,056,595 A 10/1991 Desbrandes
5,137,090 A 8/1992 Hare et al.
5,156,207 A 10/1992 Haugen et al.
5,188,182 A 2/1993 Echols, III et al.
5,281,270 A 1/1994 Totten et al.
5,310,005 A 5/1994 Dollison
5,479,986 A 1/1996 Gano et al.
5,511,617 A 4/1996 Snider et al.
5,564,502 A 10/1996 Crow et al.
5,607,017 A 3/1997 Owens et al.
5,685,372 A 11/1997 Gano
5,765,641 A 6/1998 Shy et al.
5,862,864 A 1/1999 Whiteford
5,924,696 A 7/1999 Frazier
6,076,600 A 6/2000 Vick, Jr. et al.
6,098,716 A 8/2000 Hromas et al.
6,167,957 B1 1/2001 Frazier
6,196,261 B1 3/2001 Dennistoun
6,220,350 B1 4/2001 Brothers et al.
6,227,299 B1 5/2001 Dennistoun
6,289,926 B1 9/2001 Dennistoun
6,296,061 B1 10/2001 Leismer
6,328,109 B1 12/2001 Pringle et al.
6,328,112 B1 12/2001 Malone
6,354,374 B1 3/2002 Edwards et al.
6,386,288 B1 5/2002 Snider et al.
6,394,187 B1 5/2002 Dickson et al.
6,412,388 B1 7/2002 Frazier
6,478,091 B1 * 11/2002 Gano ..... 166/373
6,536,524 B1 3/2003 Snider
6,543,538 B2 4/2003 Tolman et al.
6,575,249 B2 6/2003 Deaton
6,666,271 B2 12/2003 Deaton et al.
6,684,950 B2 2/2004 Patel
6,712,145 B2 3/2004 Allamon
6,732,803 B2 5/2004 Garcia et al.
6,742,584 B1 6/2004 Appleton
6,761,219 B2 7/2004 Snider et al.
6,808,020 B2 10/2004 Garcia et al.
6,851,471 B2 2/2005 Barlow et al.
6,851,477 B2 2/2005 Hill, Jr. et al.
6,959,763 B2 11/2005 Hook et al.
6,959,766 B2 11/2005 Connell
6,966,378 B2 11/2005 Hromas et al.
7,044,241 B2 5/2006 Angman
7,063,156 B2 6/2006 Patel et al.
7,067,445 B2 6/2006 Webber et al.
7,073,589 B2 7/2006 Tiernan et al.
7,086,480 B2 8/2006 Simpson et al.
7,086,481 B2 8/2006 Hosie et al.
7,140,443 B2 11/2006 Beierbach et al.
7,168,494 B2 1/2007 Starr et al.
7,213,653 B2 5/2007 Vick, Jr.
7,246,668 B2 7/2007 Smith
7,252,153 B2 8/2007 Hejl et al.
7,287,596 B2 10/2007 Frazier et al.
7,325,616 B2 2/2008 Lopez de Cardenas et al.
7,350,582 B2 4/2008 McKeachnie et al.
7,387,165 B2 6/2008 Lopez de Cardenas et al.
7,451,815 B2 11/2008 Hailey, Jr.
7,513,311 B2 4/2009 Gramstad et al.
7,537,062 B2 5/2009 Hughes
7,624,809 B2 12/2009 Frazier et al.
7,665,528 B2 2/2010 Ross et al.
7,708,066 B2 5/2010 Frazier
2002/0125011 A1 9/2002 Snider et al.
2002/0162662 A1 11/2002 Passamaneck et al.
2003/0047315 A1 3/2003 Allamon
2003/0155112 A1 8/2003 Tiernan et al.
2005/1008733 4/2005 Vick, Jr.
2006/0048936 A1 3/2006 Fripp et al.
2006/0070744 A1 4/2006 Smith
2006/0124310 A1 6/2006 Lopez de Cardenas et al.
2006/0124311 A1 * 6/2006 Lopez de Cardenas et al. ..... 166/313
2006/0124315 A1 * 6/2006 Frazier et al. ..... 166/369
2007/0074873 A1 4/2007 McKeachnie et al.
2008/0011487 A1 1/2008 Bertane et al.
2008/0047717 A1 2/2008 Frazier et al.
2009/0056951 A1 3/2009 Mosher et al.
2009/0242206 A1 10/2009 Goughnour et al.
2010/0163241 A1 7/2010 Klatt et al.

* cited by examiner

DOWNHOLE SLIDING SLEEVE COMBINATION TOOL

CROSS-REFERENCE TO RELATED APPLICATIONS

This application claims priority to U.S. Provisional Patent Application having Ser. No. 60/970,817, filed on Sep. 7, 2007, which is incorporated by reference herein.

BACKGROUND OF THE INVENTION

1. Field of the Invention

Embodiments of the present invention relate to a method and apparatus for perforating, stimulating, and producing hydrocarbon wells.

2. Description of the Related Art

A wellbore typically penetrates multiple hydrocarbon bearing zones, each requiring independent perforation and fracturing prior to production. Multiple bridge plugs are typically employed to isolate the individual hydrocarbon bearing zones, thereby permitting the independent perforation and fracturing of each zone with minimal impact to other zones within the well bore and with minimal disruption to production. This is accomplished by perforating and fracturing a lower zone followed by placing a bridge plug in the casing immediately above the fraced zone, thereby isolating the fraced lower zone from the upper zones and permitting an upper zone to be perforated and fraced. This process is repeated until all of the desired zones have been perforated and fraced. After perforating and fracturing each hydrocarbon bearing zone, the bridge plugs between the zones are removed, typically by drilling, and the hydrocarbons from each of the zones are permitted to flow into the wellbore and flow to the surface. This is a time consuming and costly process that requires many downhole trips to place and remove plugs and other downhole tools between each of the hydrocarbon bearing zones.

The repeated run-in and run-out of a casing string to install and remove specific tools designed to accomplish the individual tasks associated with perforating, fracturing, and installing bridge plugs at each hydrocarbon bearing interval can consume considerable time and incur considerable expense. Plugs with check valves have been used to minimize those costly downhole trips so that production can take place after fracing eliminating the need to drill out the conventional bridge plugs mentioned above. See, e.g. U.S. Pat. Nos. 4,427,071; 4,433,702; 4,531,587; 5,310,005; 6,196,261; 6,289,926; and 6,394,187. The result is a well with a very high production rate and thus a very rapid payout.

There is a need, therefore, for a multi-purpose combination tool and method for combining the same that can minimize the repeated raising and lowering of a drill string into the well.

SUMMARY OF THE INVENTION

An apparatus and method for use of a multifunction downhole combination tool is provided. The axial displacement of the sliding sleeve within the combination tool permits the remote actuation of a check valve assembly and testing within the casing string. Further axial displacement of the sliding sleeve within the combination tool provides a plurality of flowpaths between the internal and external surfaces of the casing string, such that hydraulic fracing, stimulation, and production are possible. In one or more embodiments, during run in and cementing of the well, the internal sliding sleeve is maintained in a position whereby the check valve seating surfaces are protected from damage by cement, frac slurries and/or downhole tools passed through the casing string. A liquid tight seal between the sliding sleeve and the check valve seat minimizes the potential for fouling the check valve components during initial cementing and fracing operations within the casing string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

The terms "up" and "down"; "upper" and "lower"; "upwardly" and "downwardly"; "upstream" and "downstream"; "above" and "below"; and other like terms as used herein refer to relative positions to one another and are not intended to denote a particular spatial orientation.

Figure 1:
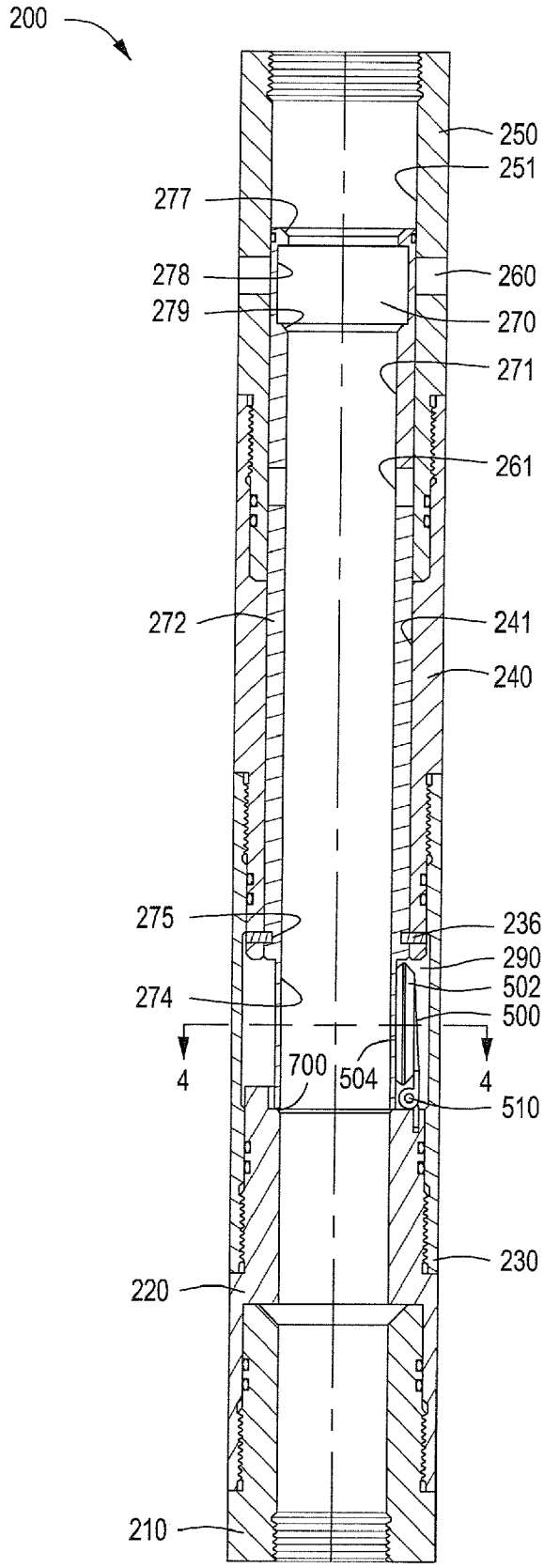
FIG. 1 depicts a partial cross sectional view of an illustrative tool in a "run-in" configuration according to one or more embodiments described.

FIG. 1 depicts a partial cross sectional view of an illustrative tool in a "run-in" configuration according to one or more embodiments described. The tool 200 can include one or more subs and/or sections threadably connected to form a unitary body/mandrel having a bore or flow path formed therethrough. In one or more embodiments, the tool 200 can include one or more first ("lower") subs 210, valve sections 220, valve housing sections 230, spacer sections 240, and second ("upper") subs 250. The tool 200 can also include one or more sliding sleeves 270, valve assemblies 500, and valve seat assemblies 700. In one or more embodiments, the tool 200 can also include one or more openings or radial apertures 260 formed therethrough to provide fluid communication between the inner bore and external surface of the tool 200.

In one or more embodiments, the valve housing section 230 can be disposed proximate the spacer section 240, and the spacer section 240 can be disposed proximate the second sub 250, as shown. In one or more embodiments, the valve section 220 can be disposed proximate the valve housing section 230. In one or more embodiments, the valve housing section can have a wall thickness less than the adjoining spacer section 240 and valve section 220. In one or more embodiments the lower sub 210 can be disposed on or about a first end (i.e. lower end) of the valve section 220, while the valve assembly 500 and valve seat 700 can be disposed on or about a second end (i.e. upper end) of the valve section 220.

In one or more embodiments, a first end (i.e. lower end) of the lower sub 210 can be adapted to receive or otherwise connect to a drill string or other downhole tool, while a second end (i.e. upper end) of the lower sub 210 can be adapted to receive or otherwise connect to the first end of the valve section 220. In one or more embodiments, the lower sub 210 can be fabricated from any suitable material, including metallic, non-metallic, and metallic/nonmetallic composite materials. In one or more embodiments, the lower sub 210 can include one or more threaded ends to permit the connection of a casing string or additional combination tool sections as described herein.

In one or more embodiments, the valve section 220 can be threadedly connected to the lower sub 210. In one or more embodiments, the valve section 220 can include one or more threaded ends to permit the threaded connection of additional combination tool sections as described herein. In one or more embodiments, the tubular, valve section 220 can be fabricated from any suitable material including metallic, non-metallic, and metallic/nonmetallic composite materials. In one or more embodiments, the valve section 220 can include one or more valve assemblies 500 and one or more valve seat assemblies 700.

In one or more embodiments, the exterior surface of the lower section 274 of the sliding sleeve 270 and the interior surface of the valve housing 230 can define the annular space 290 therebetween. In the "run-in" configuration depicted in FIG. 1, the valve assembly 500 can be trapped within the annular space 290. While in the "run-in" configuration, a liquid-tight seal can be formed by contacting the lower section 274 of the sliding sleeve 270 with the valve seat assembly 700, thereby fluidly isolating the valve assembly 500 within the annular space 290. In one or more embodiments, the liquid-tight seal, formed by the lower section 274 of the sliding sleeve 270 and the valve seat assembly 700, can protect both the valve assembly 500 and the valve seat assembly 700 from mechanical damage by wireline tools and/or fouling by fluids or other materials passed through the tool 200.

In one or more embodiments, the one or more valve assemblies 500 disposed within the tool 200 can include a sealing member 502 pivotably attached to the second (i.e. upper) end of the valve section 220 via a pivot pin 510. In one or more embodiments, the sealing member 502 can have any physical configuration capable of maintaining contact with the valve seat assembly 700 thereby sealing the cross section of the tool 200. In one or more embodiments, the physical configuration of the sealing member can include, but is not limited to, circular, oval, spherical, and/or hemispherical. In one or more embodiments, the sealing member 502 can have a circumferential perimeter that is beveled, chamfered, or another suitably finished to provide a liquid-tight seal when seated. In one or more specific embodiments, the sealing member 502 can be a circular disc having a 45° beveled circumferential perimeter adapted to provide a liquid-tight seal when seated proximate to seal assembly 700.

In one or more embodiments, a first, lower, end of the valve housing section 230 can be threadedly connected to the valve section 220. In one or more embodiments, the first valve housing section 230 can include one or more threaded ends to permit the threaded connection of additional combination tool sections as described herein. The first valve housing section 230 can be fabricated from any suitable material including metallic, non-metallic, and metallic/nonmetallic composite materials. In one or more embodiments, the first valve housing section 230 can be fabricated from thinner wall material than the second sub 250 and lower sub 210, which can provide the annular space 290 between the first valve housing section 230 and the lower section 274 of the sliding sleeve.

In one or more embodiments, a first, lower, end of the spacer section 240 can be threadedly connected to the second end of the first valve housing section 230. In one or more embodiments, the second end of the spacer section 240 can be threaded to permit the connection of additional combination tool sections as described herein. The spacer section 240 can be fabricated from any suitable material, including metallic, non-metallic, and metallic/nonmetallic composite materials. In one or more embodiments, the spacer section 240 can contain one or more apertures through which one or more shear pins 236 can be inserted to seat in mating recesses 275 within the sliding sleeve 270, which can affix the sliding sleeve 270 in the "run in" configuration depicted in FIG. 1. In one or more embodiments, the interior surface 241 of the spacer section 240 can be suitably finished to provide a smooth surface upon which the sliding sleeve 270 can be axially displaced along a longitudinal axis. In one or more embodiments, the interior surface 241 of the spacer section 240 can have a roughness of about 0.1 μm to about 3.5 μm Ra. In one or more embodiments, the overall length of the spacer section 240 can be adjusted based upon wellbore operating conditions and the preferred distance between the valve assembly 500 and the radial apertures 260.

In one or more embodiments, a first, lower, end of the second sub 250 can be threadedly connected to the second, upper, end of the spacer section 240. In one or more embodiments, the second, upper, end of the second sub 250 can be threaded to permit the connection of a casing string or additional combination tool sections as described herein. The second sub 250 can be fabricated from any suitable material, including metallic, non-metallic, and metallic/nonmetallic composite materials. In one or more embodiments, the second sub 250 can include at least on radial apertures 260 providing a plurality of flowpaths between the interior and exterior surfaces of the second sub 250. In one or more embodiments, an interior surface 251 of the upper sub can be suitably finished to provide a smooth surface upon which the sliding sleeve 270 can be axially displaced along a longitudinal axis. In one or more embodiments, the interior surface 251 of the upper sub can have a roughness of about 0.1 μm to about 3.5 μm Ra.

In one or more embodiments, the sliding sleeve 270 can be fabricated using metallic, non-metallic, metallic/nonmetallic composite materials, or any combination thereof. In one or more embodiments, the sliding sleeve can be an annular member having a lower section 274 with a first outside diameter and a second, upper, section 272 with a second outside diameter. In one or more embodiments, the first outside diameter of the lower section 274 can be less than the second outside diameter of the second section 272. In one or more embodiments, the second outside diameter of the sliding sleeve 270 can be slightly less than the inside diameter of the second sub 250; this arrangement can permit the concentric disposal of the sliding sleeve 270 within the second sub 250. In one or more embodiments, the outside surface of the second section 272 can be suitably finished to provide a smooth surface upon which the sliding sleeve 270 can be displaced within the spacer section 240 and the second sub 250. In one or more embodiments, the exterior circumferential surface of the second section 272 can have a roughness of about 0.1 μm to about 3.5 μm Ra.

In one or more embodiments, the inside surfaces 271 of the second section 272 of the sliding sleeve 270 can be fabricated with a first shoulder 277, an enlarged inner diameter section 278, and a second shoulder 279, which can provide a profile for receiving the operating elements of a conventional design setting tool. The use of a conventional design setting tool, well known to those of ordinary skill in the art, can enable the axial displacement or shifting, of the sliding sleeve 270 to the "test" and "fracing/production" configurations discussed in greater detail with respect to FIGS. 2 and 3. In one or more embodiments, the inner diameter of the sliding sleeve 270 can be of similar diameter to the uphole and downhole casing string sections (not shown in FIG. 1) attached to the tool 200. The large bore of the tool 200 while in the "run in" configuration depicted in FIG. 1 can facilitate downhole operations by providing a passage comparable in diameter to adjoining casing string sections, which can permit normal operations within the casing string while simultaneously preventing physical damage or fouling of the valve assembly 500 and valve seat assembly 700.

In one or more embodiments, a plurality of apertures 261 can be disposed in a circumferentially about the second section 272 of the sliding sleeve 270. At least another radial aperture 260 can be disposed in a matching circumferential pattern about the second sub 250, such that when the sliding sleeve 270 is displaced a sufficient distance along the longitudinal axis of the tool 200, the apertures 261 in the sliding sleeve 270 will align with the radial apertures 260 in the second sub 250, which can create a plurality of flowpaths between the bore and the exterior of the tool 200. As depicted in FIG. 1, during "run-in" the second section 272 of the sliding sleeve 270 blocks the radial apertures 260 through the second sub 250, which can prevent fluid communication between the bore and exterior of the tool 200.

In one or more embodiments, the lower end of the lower section 274 of the sliding sleeve can be chamfered, beveled or otherwise finished to provide a liquid-tight seal when proximate to the valve seat assembly 700 in the "run-in" configuration as depicted in FIG. 1. In one or more embodiments, the lower end of the lower section 274 of the sliding sleeve can be held proximate to the valve seat 700 while in the "run-in" configuration using one or more shear pins 236 inserted into mating recesses 275 on the outside diameter of the second section 272 of the sliding sleeve. The liquid-tight seal between the lower end of the lower section 274 of the sliding sleeve and the valve seat 700 provides several benefits: first, the sliding sleeve protects the valve seat from damage caused by abrasive slurries (e.g. frac slurry and cement) handled within the casing string; second, the sliding sleeve protects the valve seat from mechanical damage to the valve seat from downhole tools operating within the casing string; finally, the liquid tight seal prevents the entry of fluids into the annular space 290 housing the valve assembly 500.

Figure 2:
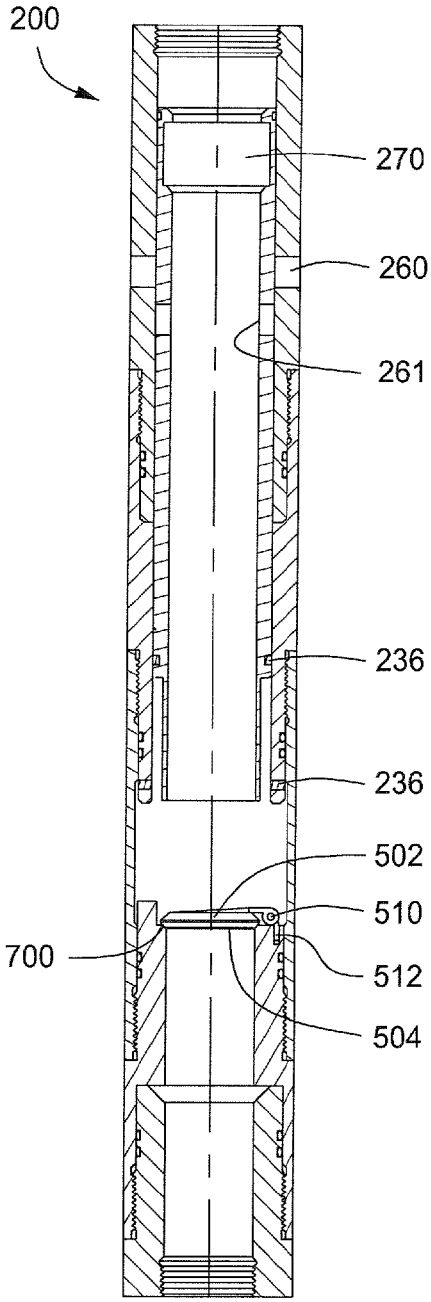
FIG. 2 depicts a partial cross sectional view of an illustrative tool in a "test" configuration according to one or more embodiments described.

FIG. 2 depicts a partial cross sectional view of an illustrative tool 200 in a "test" configuration according to one or more embodiments described. In one or more embodiments, any conventional downhole shifting device may be used to apply an axial force sufficient to shear the one or more shear pins 236 and axially displace the sliding sleeve 270 to the test position depicted in FIG. 2. The sliding sleeve 270 can be axially displaced or shifted using a shifting tool of any suitable type, for example, a setting tool offered through Tools International, Inc. of Lafayette, La. under the trade name "B Shifting Tool." Although mechanical means for moving the sliding sleeve 270 have been mentioned by way of example, the use of hydraulic, or other, actuation means can be equally suitable and effective for displacing the sliding sleeve 270.

In the test configuration, unidirectional flow can occur through the tool 200. When the axial displacement of the sliding sleeve 270 fully exposes the valve assembly 500, the sealing member 502, urged by an extension spring 512, pivots on the pivot pin 510 from the storage position ("the first position") parallel to the longitudinal centerline of the tool to an operative position ("the second position") transverse to the longitudinal centerline of the tool. As depicted in FIG. 2, in the test configuration, the circumferential perimeter 504 of the sealing member 502 contacts the valve seat assembly 700. In the test configuration, the valve assembly 500 permits unidirectional, fluid communication through the tool 200 while the sliding sleeve 270 continues to block the radial apertures 260 through the second sub 250. Note that in the test configuration, the plurality of apertures 261 in the sliding sleeve 270 are not aligned with the radial apertures 260 in the second sub 250, thus precluding fluid communication between the interior and exterior of the tool 200.

Figure 3:
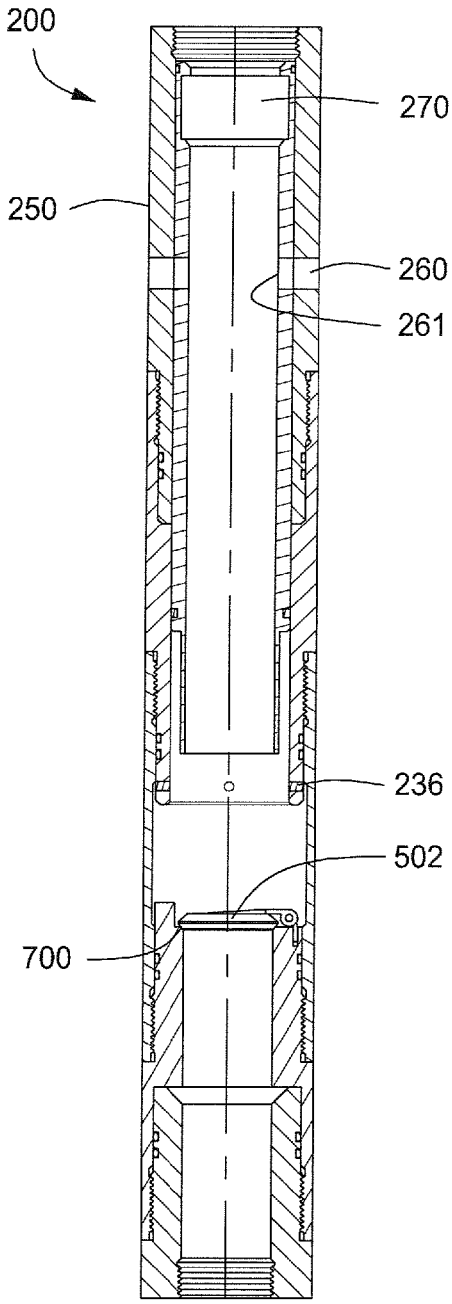
FIG. 3 depicts a partial cross sectional view of an illustrative tool in a "fracing/production" configuration according to one or more embodiments described.

FIG. 3 depicts a partial cross sectional view of an illustrative tool 200 in a fracing/production position according to one or more embodiments described. In the fracing/production configuration, the sliding sleeve 270 has been axially displaced a sufficient distance to align the plurality of apertures 261 in the sliding sleeve 270 with the radial apertures 260 in the second sub 250, which can create a plurality of flowpaths between the bore and exterior of the tool 200. In one or more embodiments, a conventional downhole shifting device well-known to those of ordinary skill in the art, can be used to axially displace the sliding sleeve 270 from the "test" configuration depicted in FIG. 2 to the "fracing/production" configuration depicted in FIG. 3.

In the fracing/production configuration depicted in FIG. 3, fluid communication between the interior and exterior of the tool 200 is permitted. Such fluid communication is advantageous for example when it is necessary to fracture the hydrocarbon bearing zones surrounding the tool 200 by pumping a high pressure slurry through the casing string, into the bore of the tool 200. The high pressure slurry passes through the plurality of flowpaths formed by the alignment of the radial apertures 260 and plurality of apertures 261. The high pressure slurry can fracture both the cement sleeve surrounding the casing string and the surrounding hydrocarbon bearing interval; after fracturing, hydrocarbons can freely flow from the zone surrounding the tool 200 to the interior of the tool 200. The sealing member 502, transverse to the axial centerline of the tool 200, forms a tight seal against the valve seat assembly 700, preventing any hydrocarbons entering the tool 200 through the plurality of flowpaths formed by the alignment of the radial apertures 260 and the plurality of apertures 261 from flowing downhole. Should the pressure of the fluids trapped beneath the sealing member 502, exceed the pressure of the hydrocarbons in the bore of the tool, the sealing member 502 can lift, thereby permitting the trapped fluids to flow uphole, through the tool 200.

Figure 4:
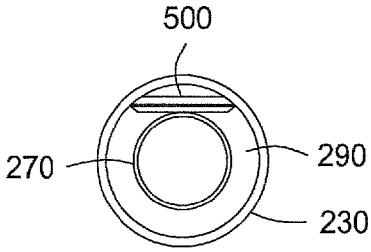
FIG. 4 depicts a top perspective view of an illustrative valve assembly in the first position.

FIG. 4 depicts the valve assembly 500 with the tool 200 in the run-in configuration. In one or more embodiments, the valve assembly 500 can be stored as depicted in FIG. 4. The valve assembly 500 can be maintained in the annular space 290 formed internally by the sliding sleeve 270 and externally by the valve housing section 230.

Figure 5:
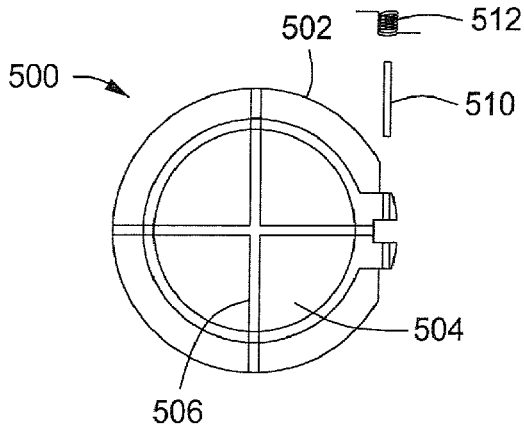
FIG. 5 depicts a break away schematic of an illustrative valve assembly according to one or more embodiments described.

FIG. 5 depicts break away schematic of an illustrative valve assembly 500 according to one or more embodiments described. In one or more embodiments, the sealing member 502 can be fabricated from any frangible material, such as cast aluminum, ceramic, cast iron or any other equally resilient, brittle material. In one or more embodiments, grooves 506 can be scored into an upper face of the sealing member 502 to structurally weaken and increase the susceptibility of the sealing member 502 to fracture upon the application of a sudden impact force, for example, the force exerted by a drop bar inserted via wireline into a wellbore. While a flat circular sealing member 502 has been depicted in FIG. 5, other equally effective, substantially flat geometric shapes including conic and polygonic sections can be equally efficacious.

In one or more embodiments, the sealing member 502 can pivot from the first position parallel to the longitudinal centerline of the combination tool 200 to the second position transverse to the longitudinal centerline of the combination tool 200. In one or more embodiments, a pivot pin 510 extending through the extension spring 512 can be used as a hinge to pivot the pivotably mounted member 502 from the first position to the second position. In one or more embodiments, the extension spring 512 can be pre-tensioned when the valve assembly 500 is in the run-in position (i.e. with the sealing member parallel to the longitudinal centerline of the tool 200). The axial displacement of the sliding sleeve 270 to the test configuration depicted in FIG. 2 exposes the sealing member 502. The exposure of the sealing member 502 can release the tension in the extension spring 512 and permit the spring to urge the movement of the sealing member 502 into contact with the valve seat assembly 700.

Figure 6:
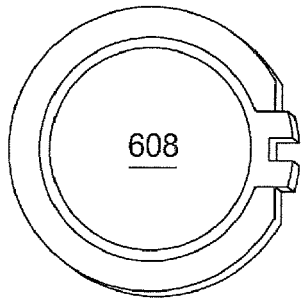
FIG. 6 depicts a bottom view of an illustrative sealing member according to one or more embodiments described.

FIG. 6 depicts a bottom view of an illustrative sealing member 502 according to one or more embodiments described. In one or more embodiments, the lower surface of the pivotably mounted member 502 can include a concave lower face 608 for greater resiliency to uphole pressure than an equivalent diameter flat face sealing member 502.

Figure 7:
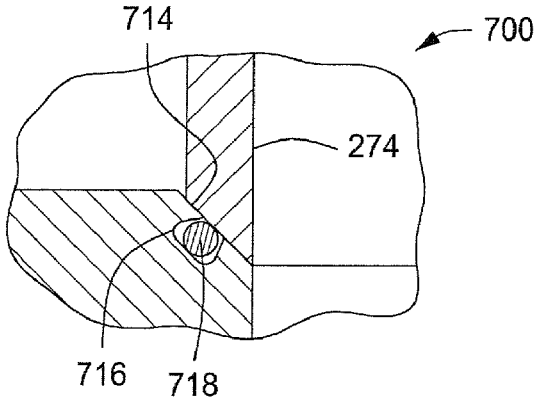
FIG. 7 depicts a partial, enlarged, cross-sectional view of an illustrative valve seat assembly according to one or more embodiments described.

FIG. 7 depicts a partial, enlarged, cross-sectional view of an illustrative valve seat assembly 700 according to one or more embodiments described. In one or more embodiments, the upper end of the valve assembly 220 can be a chamfered valve seat 714. The chamfered valve seat 714 can have one or more grooves 716 and O-rings 718. In one or more embodiments, the lower end of the lower section 274 can be complimentarily chamfered to ensure a proper fit with the valve seat 714, thereby covering and protecting the one or more O-ring seals 718 disposed within one or more grooves 716. In one or more embodiments, the valve seating surface 720 can be chamfered, beveled or otherwise fabricated, or machined in a complementary fashion to the lower end of the lower section 274 of the sliding sleeve to provide a liquid tight seal therebetween. In this configuration, fluids or materials, such as cement and/or frac slurry, inside of the combination tool 200 can not contact or damage the O-ring 718 or valve assembly 500 while the tool is maintained in the run-in configuration depicted in FIG. 1.

Figure 8:
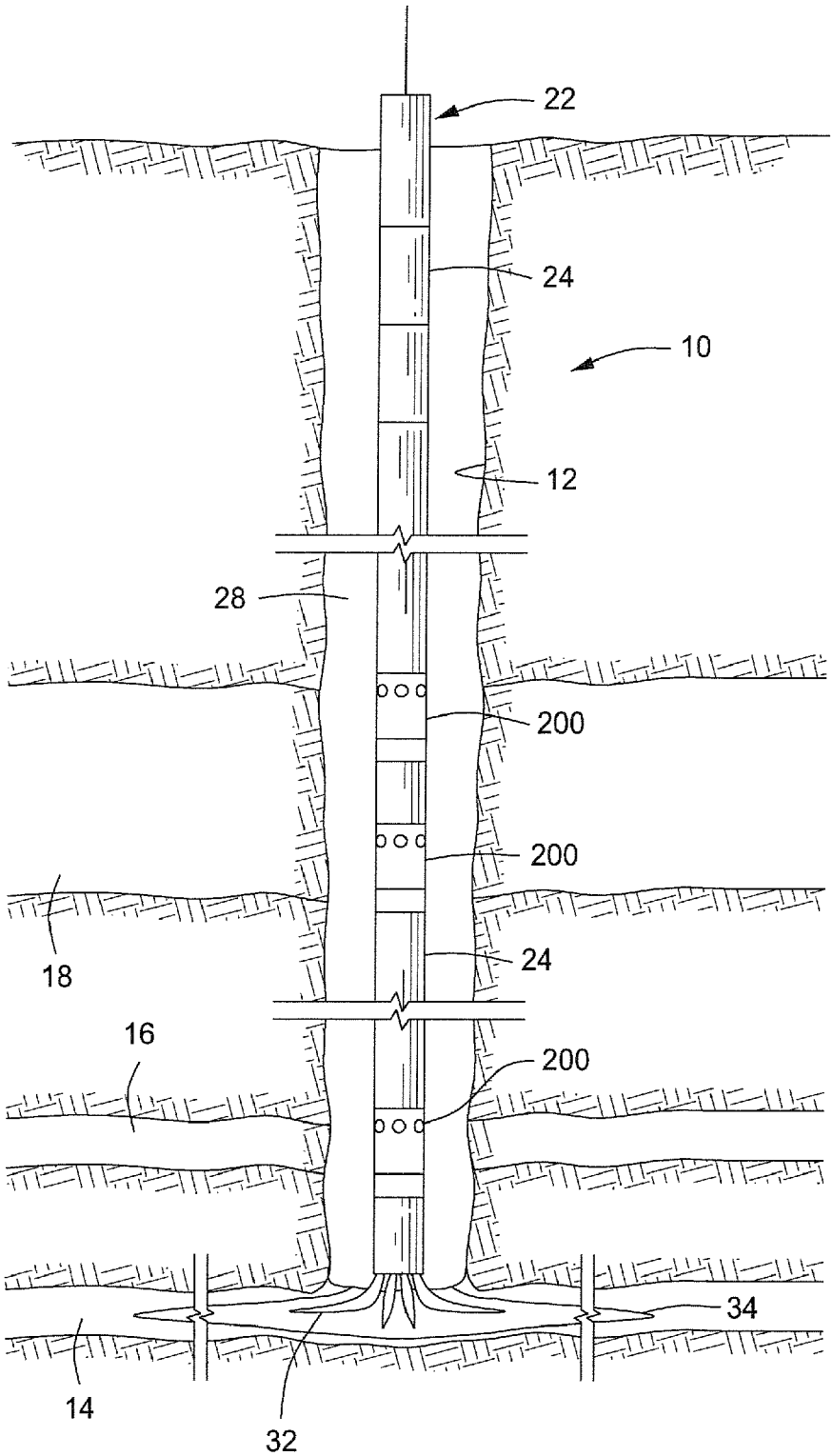
FIG. 8 depicts is a schematic of an illustrative wellbore using multiple tools disposed between zones, according to one or more embodiments described.

FIG. 8 depicts one or more illustrative combination tools 200 disposed between multiple hydrocarbon bearing zones penetrated by a single wellbore 12. A hydrocarbon producing well 10 can include a wellbore 12 penetrating a series of hydrocarbon bearing zones 14, 16, and 18. A casing string 22 can be fabricated using a series of threaded pipe sections 24. The casing string 22 can be permanently placed in the wellbore 12 in any suitable manner, typically within a cement sheath 28. In one or more embodiments, one or more combination tools 200 can be disposed along the casing string 22 at locations within identified hydrocarbon bearing zones, for example in hydrocarbon bearing zones 16 and 18 as depicted in FIG. 8. In one or more embodiments, one or more combination tools 200 can be disposed along the casing string 22 within a single hydrocarbon bearing zone, for example in hydrocarbon bearing interval 18 depicted in FIG. 8. The positioning of multiple combination tools 200 along the casing string enables the testing, fracing, and production of various hydrocarbon bearing zones within the wellbore without impacting previously tested, fraced, or produced downhole hydrocarbon bearing zones.

In one or more embodiments, a typical hydrocarbon production well 12 can penetrate one or more hydrocarbon bearing intervals 14, 16, and 18. After the wellbore 12 is complete, the casing string 22 can be lowered into the well. As the casing string 22 is assembled on the surface, one or more tools 200 can be disposed along the length of the casing string at locations corresponding to identified hydrocarbon bearing intervals 14, 16, and 18 within the wellbore 12. While inserting the casing string 22 into the wellbore 12, all of the combination tools 200 will be in the run-in position as depicted in FIG. 1.

In one or more embodiments, cement can be pumped from the surface through the casing string 22, exiting the casing string 22 at the bottom of the wellbore 12. The cement will flow upward through the annular space between the wellbore 12 and casing string 22, providing a cement sheath 28 around the casing string, stabilizing the wellbore 12, and preventing fluid communication between the hydrocarbon bearing zones 14, 16, and 18 penetrated by the wellbore 12. After curing, the lowermost hydrocarbon bearing zone 14 can be fractured and produced by pumping a frac slurry at very high pressure into the casing string 22. Sufficient hydraulic pressure can be exerted to fracture the cement sheath 32 at the bottom of the casing string 22. When the cement sheath 32 is fractured the frac slurry 34 can flow into the surrounding hydrocarbon bearing zone 14. The well can then be placed into production, with hydrocarbons flowing from the lowest hydrocarbon bearing interval 14 to the surface via the unobstructed casing string 22.

When production requirements dictate the fracing and stimulation of the next hydrocarbon bearing zone 16, a downhole shifting tool (not shown) can be inserted by wireline (also not shown) into the casing string 22. The shifting tool can be used to shift the sliding sleeve in the tool 200 located within hydrocarbon bearing zone 16 to the "test" position, permitting the valve assembly 500 to deploy to the operative position transverse to the casing string. In this configuration, while uphole flow is possible, downhole flow is prevented by the valve assembly 500 in the tool 200 located within the hydrocarbon bearing zone 16. The integrity of the casing string 22 and valve assembly can be tested by introducing hydraulic pressure to the casing string and evaluating the structural integrity of both the casing string and the valve assembly 500 inside the tool 200 located in hydrocarbon bearing zone 16.

Assuming satisfactory structural integrity, the shifting tool can be used to shift the sliding sleeve in the tool 200 located within hydrocarbon bearing zone 16 to the "fracing/production" position whereby fluid communication between the interior and exterior of the tool 200 is possible. Once the tool 200 is in the fracing/production configuration, high pressure frac slurry can be introduced to the casing string 22. The high pressure frac slurry flows through the plurality of apertures in the tool 200, exerting sufficient hydraulic pressure to fracture the cement sheath 28 surrounding the tool 200. The frac slurry can then flow through the fractured concrete into the surrounding hydrocarbon bearing zone 16. The well can then be placed into production, with hydrocarbons from zone 16 flowing through the plurality of apertures in the tool 200, into the casing string and thence to the surface. The valve assembly 500 in the tool 200 prevents the downhole flow of hydrocarbons to lower zones (zone 14 as depicted in FIG. 8), while permitting uphole flow of hydrocarbons from lower zones within the wellbore.

In similar fashion, the one or more successive combination tools 200 located in hydrocarbon bearing interval 18 can be successively tested, fraced, and produced using conventional shifting tools and hydraulic pressure. The use of one or more combination tools 200 eliminates the need to use explosive type perforating methods to penetrate the casing string 22 to fracture the cement sheath 28 surrounding the casing string 22. Since the valve assembly 500 and apertures in the combination tool 200 can be actuated from the surface using a standard setting tool, communication between the interior of the casing string 22 and multiple surrounding hydrocarbon bearing intervals 14, 16, and 18 can be established without repeated run-in and run-out of downhole tools. Hence, the incorporation of the valve assembly 200 and apertures into a single combination tool 200 minimizes the need to repeatedly run-in and run-out the casing string 22.

The position of the valve assembly 500, transverse to the wellbore, can permit the accumulation of uphole well debris on top of the valve assembly 500. Generally, sufficient downhole fluid pressure will lift the valve assembly 500 and flush the accumulated debris from the casing string. In such instances, the well 10 can be placed into production without any further costs related to cleaning debris from the well.

If, after placing the valve assembly 500 into the second position transverse to the longitudinal axis of the combination tool 200, the valve assembly 500 is rendered inoperable for any reason, including, but not limited to, accumulated debris on top of the valve assembly 500, fluid communication through the tool may be restored by inserting a drop bar via wireline into the wellbore 12, fracturing the sealing member 502 within the one or more tools 200. In one or more embodiments, the sealing member 502 can be fabricated from an acid or water soluble composite material such that through the introduction of an appropriate solvent to the casing string, the sealing member 502 can be dissolved.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A downhole tool comprising:

a body having a bore formed therethrough;

a sliding sleeve at least partially disposed in the body;

one or more openings disposed about the body at a first end thereof; and a valve assembly and a valve seat assembly at least partially disposed within the bore at a second end thereof, wherein:

in a first axial position, the sliding sleeve is adapted to block the one or more openings and maintain the valve assembly in an open position allowing bidirectional flow through the bore;

in a second axial position, the sliding sleeve is adapted to close the valve assembly, allowing unidirectional flow through the bore;

in a third axial position, the sliding sleeve is adapted to uncover the one or more openings thereby creating one or more of flowpaths between the bore and an exterior surface of the downhole tool, while permitting unidirectional flow through the bore; and the sliding sleeve comprising one or more sleeve apertures that when aligned with the one or more openings disposed about the body, in the third axial position, create the one or more flowpaths.

2. The downhole tool of claim 1, wherein the valve assembly comprises a pivotable sealing member, and wherein the sliding sleeve is axially displaced to permit the pivotable sealing member to pivot from the first position to the second position.

3. The downhole tool of claim 2, wherein the pivotable sealing member comprises a frangible material.

4. The downhole tool of claim 2, wherein the pivotable sealing member comprises a material selected from the group consisting of cast iron, cast aluminum, and ceramic.

5. The downhole tool of claim 2, wherein the pivotable sealing member comprises a compound soluble water, organic acids, inorganic acids, organic bases, inorganic bases, organic solvents, or combinations thereof.

6. The downhole tool of claim 1, wherein the valve seat assembly is of frustoconical shape.

7. The downhole tool of claim 1, wherein a second end of the sliding sleeve comprises a complementary shape to the valve seat assembly, thereby permitting the formation of a liquid-tight seal when the second end of the sliding sleeve is proximate to the valve seat assembly.

8. The downhole tool of claim 1, wherein the downhole tool is disposed on a casing string, and wherein an inside diameter defined by the bore of the downhole tool is greater than or equal to an internal diameter of the casing string.

9. A system for hydrocarbon production from a well, the system comprising:

a well bore;

a casing string comprising one or more casing sections and one or more combination tools, wherein each combination tool is the downhole tool of claim 1.

10. The downhole tool of claim 9, wherein the valve assembly comprises a pivotable sealing member, and wherein the internal sliding sleeve is axially displaced to permit the pivotable sealing member to pivot from a first position to a second position.

11. The downhole tool of claim 10, wherein the pivotable sealing member comprises a frangible material.

12. The downhole tool of claim 10, wherein the pivotable sealing member comprises cast iron, cast aluminum, ceramic, or combinations thereof.

13. The downhole tool of claim 9, wherein the valve seat assembly is of frustoconical shape.

14. The downhole tool of claim 9, wherein a second end of the sliding sleeve comprises a complementary shape to the valve seat assembly.

15. The downhole tool of claim 9, wherein an inside diameter defined by the bore of the downhole tool is greater than or equal to an internal diameter of the casing string.

* * * * *